US005475368A

United States Patent [19]

Collins

[11] Patent Number: 5,475,368

[45] Date of Patent: Dec. 12, 1995

[54] KEY CHAIN ALARM AND LIGHT

[75] Inventor: David A. Collins, Hot Springs, Ark.

[73] Assignee: Dac Technologies of America Inc., Little Rock, Ark.

[21] Appl. No.: 269,784

[22] Filed: Jul. 1, 1994

[51] Int. Cl.[6] ..... G08B 23/00

[52] U.S. Cl. ..... 340/573; 340/691; 340/693; 340/391.1; 340/574

[58] Field of Search ..... 340/573, 574, 340/691, 693, 321, 326, 384, 391.1, 388.4; 310/321, 323, 334, 335

[56] References Cited

U.S. PATENT DOCUMENTS

| | | | |
|---|---|---|---|
| 3,728,674 | 4/1973 | Kahn | 340/63 |
| 4,241,332 | 12/1980 | Farque | 340/326 |
| 4,262,180 | 4/1981 | Walter | 200/153 |
| 4,262,285 | 4/1981 | Polley | 340/574 |
| 4,284,982 | 8/1981 | Downey | 340/546 |
| 4,404,549 | 9/1983 | Berg | 340/574 |
| 4,438,428 | 3/1984 | Ober | 340/521 |
| 4,462,023 | 7/1984 | Nielsen | 340/571 |
| 4,473,821 | 9/1984 | Yang | 340/539 |
| 4,520,351 | 5/1985 | Altman | 340/574 |
| 4,587,516 | 5/1986 | Hiraki | 340/539 |
| 4,667,188 | 5/1987 | Schwartz | 340/689 |
| 4,716,402 | 12/1987 | Francis | 340/693 |
| 4,837,559 | 6/1989 | Green, Sr. | 340/573 |
| 5,001,462 | 3/1991 | Seemann | 340/574 |
| 5,005,002 | 4/1991 | Halperin | 340/574 |
| 5,032,824 | 7/1991 | Corbin | 340/574 |
| 5,075,671 | 12/1991 | Livingston, III | 340/574 |
| 5,274,358 | 12/1993 | Janis | 340/691 |
| 5,317,305 | 5/1994 | Campman | 340/691 |

*Primary Examiner*—John K. Peng
*Assistant Examiner*—Benjamin C. Lee
*Attorney, Agent, or Firm*—Stephen D. Carver; Trent C. Keisling

[57] ABSTRACT

A key chain alarm and light is disclosed that overcomes the problems associated with prior art personal alarms. The invention combines the functionality of a key chain, flashlight and an alarm into a unitary assembly. The invention is physically diminutive in size and ergonomically shaped to facilitate its handling. However, it produces an audible alarm significantly louder than other prior art devices. The invention utilizes a unique speaker assembly to produce an extremely loud alarm signal. A piezoelectric transducer provides the vibratory medium. The vibrations produced by the transducer are acoustically focused and harmoniously amplified by an acoustic chamber before passing into a reverberation chamber. The reverberation chamber also increases the amplitude of the sound waves before selectively releasing them to produce the alarm signal. This signal immediately draws attention to the user in emergency situations. The alarm is easily activated by simply moving a switch to activate the alarm. The alarm can also be easily deactivated by reversing the switch. The switch also cooperatively activates the light. A push button on the exterior of the casing of the key chain alarm and light must also be depressed to activate the light.

7 Claims, 8 Drawing Sheets

KEY CHAIN ALARM AND LIGHT

BACKGROUND OF THE INVENTION

I. Field of the Invention

The present invention relates generally to personal safety devices for use by individuals wherein a self-contained alarm is vigorously activated during emergency situations. More particularly, the present invention relates to a portable hand-held, personal alarm adapted to be attached to key chains. Relevant prior art personal alarms may be found in United States Patent Class 340 and the many subclasses listed thereunder.

II. Description of the Prior Art

As will be recognized by those skilled in the art, personal, portable alarms are gaining in popularity. Many comprise battery operated signaling devices that emit an audible when activated. Typically, the alarms are user activated in emergency situations. Such alarms draw attention to the user by alerting bystanders that the user is in need of assistance. These alarms have several common features and functions. Generally, the alarm is activated by pressing a manually activated switch.

Personal alarms functioning in this manner are well-known in the prior art. Several alarms employ simple push button switches for activation and deactivation, like Seemann, U.S. Pat. No. 5,001,462. Halperin, U.S. Pat. No. 5,005,002, alarm physically separates the activation button and the termination button.

Green, U.S. Pat. No. 4,837,559, discloses a personal security device which is passively activated. This device employs a clip that activates the device when the clip is removed from the individual's clothing.

Personal alarms employing a pull-pin are also present in the prior art. Among these are Kahn, U.S. Pat. No. 3,728,674, that makes references to a plunger which may be pulled out. Polley, U.S. Pat. No. 4,262,285, employs a lever to actuate a personal alarm. This lever actuates a pin which is the actual switch. Walter, U.S. Pat. No. 4,262,180, discloses an alarm switch which has a knife shaped pin for activation as well as a recessed button. Downey, U.S. Pat. No. 4,284,982, discloses a battery operated personal alarm which is activated by a pull-pin.

Other alarms employ more sophisticated deactivation mechanisms. Livingston, U.S. Pat. No. 5,075,671, locks on a user's wrist until it is deactivated and removed. Berg, U.S. Pat. No. 4,404,549, employs a key switch for deactivation. Altman, U.S. Pat. No. 4,520,351, and Corbin, U.S. Pat. No. 5,032,824, each employ a plurality of secondary "dip" switches which must be properly aligned to deactivate the alarm.

Other alarms employ a mercury switch to insure they are activated at the proper time. Nielsen, U.S. Pat. No. 4,462,023, is a personal property alarm which is intended to be attached to a article of personal property. When the article is moved, a mercury switch activates the alarm. Deactivation can only be accomplished by removing the batteries.

Other personal alarms present in the art may be used as an alarm for a door or window. Ober, U.S. Pat. No. 4,438,428, employs a switch activated by an arm which extends outwardly to contact a window. Schwartz, U.S. Pat. No. 4,667,188 may be positioned next to a door to act as an alarm. This device employs an on/off switch on its top and an activation bar on its side. The activation bar can be positioned adjacent a door to activate the alarm when the door opens. It also has a mercury switch which prevents activation unless it is tilted to one side.

Some personal alarms employ remote activation devices which are connected to the alarm unit by pairs of transmitting and receiving units. Hiraki, U.S. Pat. No. 4,587,516; Farque, U.S. Pat. No. 4,241,332; and Yang, U.S. Pat. No. 4,473,821 are examples of this type of personal alarm.

Sometimes prior art personal alarms have also incorporated lights or flashing lights into their design. Farque, Seemann, Livingston III, Corbin, Ober and Green, Sr. of the above referenced prior art patents all incorporate some type of a light into their device.

However, the prior art alarms are generally bulky and unwieldy. This makes the prior art alarms difficult to utilize effectively or to store conveniently. As a result, the alarm is often intentionally left behind or simply forgotten or misplaced.

Another problem with the prior art alarms is the ratio of the decibel level produced by the alarm to the battery size. Prior art alarms require large batteries to produce an alarm signal of the necessary decibel level.

Therefore, it is desirable to provide a personal alarm that is physically diminutive to facilitate its use and storage. It would also be desirable to maximize the ratio of the decibel level of the alarm signal to the size of the battery. Another desirable attribute would be the combination of the personal alarm with several other personal items.

My new Key Chain Alarm and Light is designed to function as a key chain and a personal security alarm and a flashlight. The device is physically diminutive. Importantly, the ratio of decibel level to battery size is much higher than the prior art devices.

SUMMARY OF THE INVENTION

I have designed a key chain alarm and light that overcomes the problems associated with prior art personal alarms. My key chain alarm and light combines the functionality of a key chain, flashlight and an alarm into a unitary assembly. My invention is physically diminutive in size and ergonomically shaped to facilitate its handling. It produces a piercing noise when activated that is significantly greater than any known unit of comparable physical size.

My alarm utilizes a unique speaker assembly to efficiently produce a loud alarm signal. A piezoelectric transducer provides the vibratory medium. The vibrations produced by the transducer are focused by an acoustic chamber before being transmitted to an adjacent sound distribution chamber. The distribution chamber amplifies and harmonizes the acoustic sound waves before selectively radiating them to produce the alarm signal. This signal immediately draws attention to the user in emergency situations.

The alarm is easily activated by simply moving a switch. The alarm can be deactivated by reversing the switch. The switch also activates the light source (normally a L.E.D.) in cooperation with a push button on the exterior of the casing of the alarm.

Thus a primary object of the present invention is to provide an improved personal alarm.

A related object of the invention is to provide an alarm that maximizes the sound intensity.

A more basic object is to provide an alarm that is physically diminutive and ergonomically shaped so that the device can be held and operated in one hand.

A related object of the invention is to provide an alarm of the character described that is inexpensive to manufacture.

Another object of the invention is to provide an alarm that requires minimal maintenance.

An important object of the invention is to provide an alarm that combines multiple functions into a unitary assembly.

Another basic object of the invention is to provide an alarm that is simple to activate and deactivate.

A related object is to provide an alarm that requires minimal instruction prior to use.

Yet another related object of the invention is to provide an alarm that is easily user activated during emergency situations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
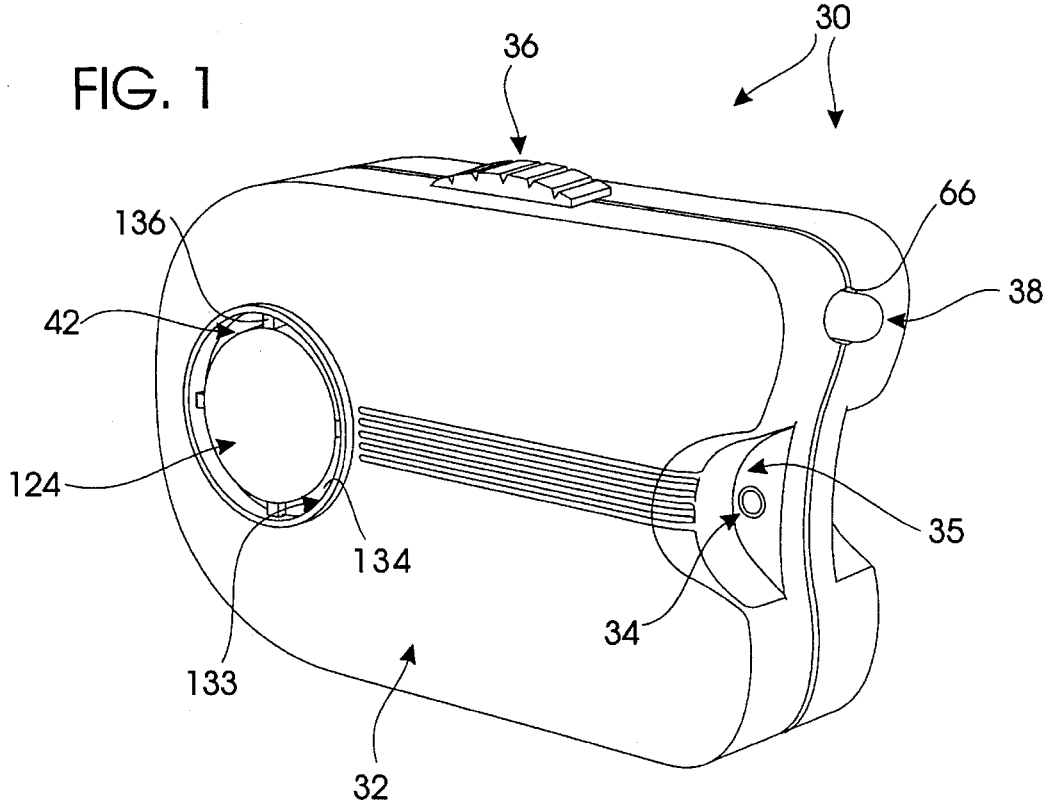
FIG. 1 is a front perspective view showing the best mode of my key chain alarm and light.
Figure 2:
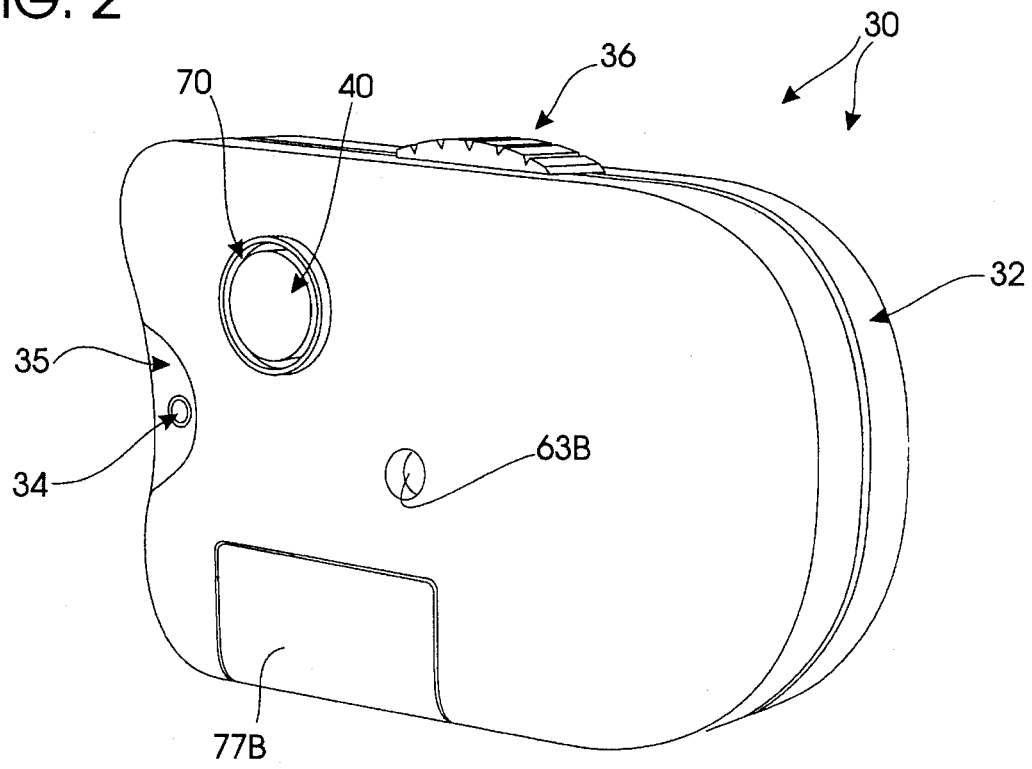
FIG. 2 is a rear perspective view of the invention.
Figure 3:
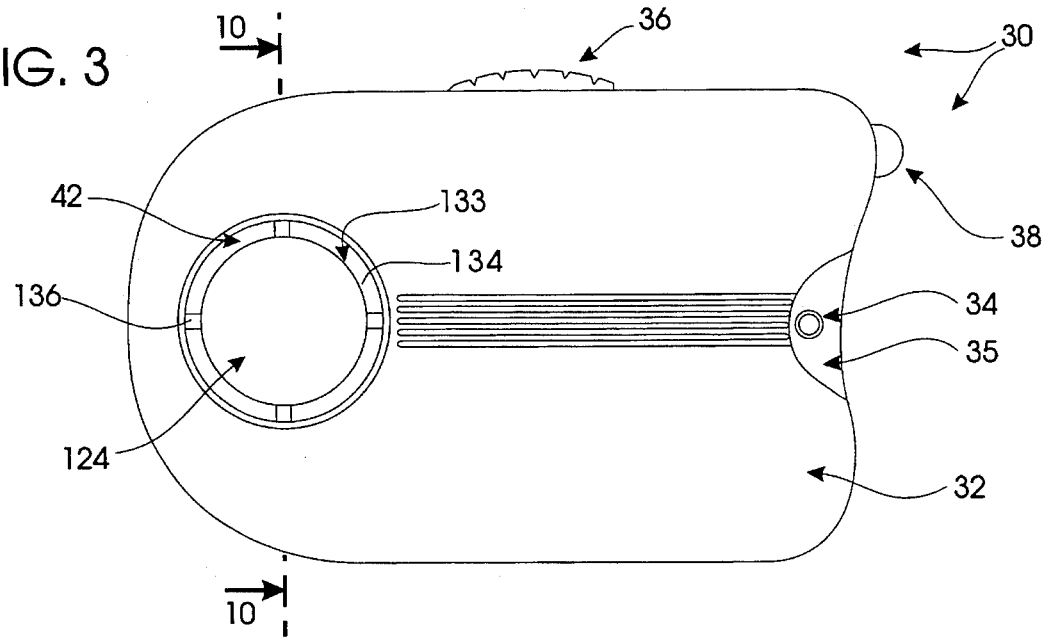
FIG. 3 is a front elevational view of the invention.
Figure 4:
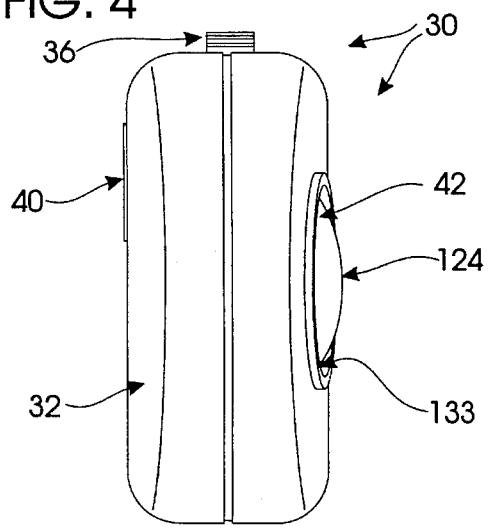
FIG. 4 is a left end elevational view of the invention.
Figure 5:
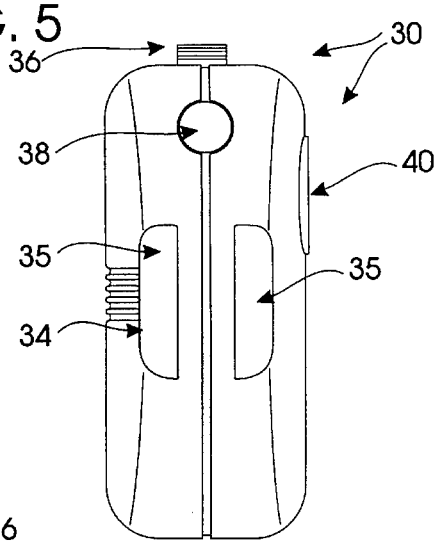
FIG. 5 is a right end elevational view of the invention.
Figure 6:
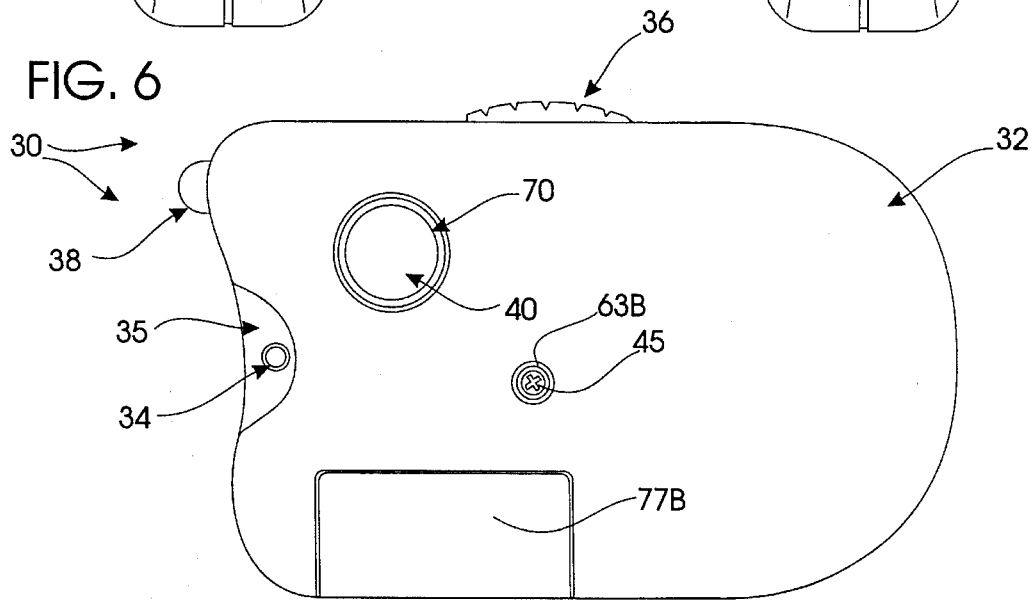
FIG. 6 is a rear elevational view of the invention.

Referring more specifically to the drawings, my improved Key Chain Alarm and Light is broadly designated by reference numeral 30 (FIGS. 1–6). The principle components of the key chain alarm and light 30 are contained by the resilient, molded casing 32. The eyelet 34, the main switch 36, the light 38 and the push button 40 (FIG. 2) are associated with the casing 32. The speaker assembly 42 is primarily contained within the casing 32.

The casing 32 fits conveniently within the palm of most people, with the alarm and light easily activated by the user's thumb. The ergonomic design of the casing 32 also facilitates the use of the key chain alarm and light 30 as a defensive weapon. A reduced portion 35 cooperates with the forefingers of the individual to promote the use of the key chain alarm and light 30 as a defensive jabbing weapon.

Figure 7:
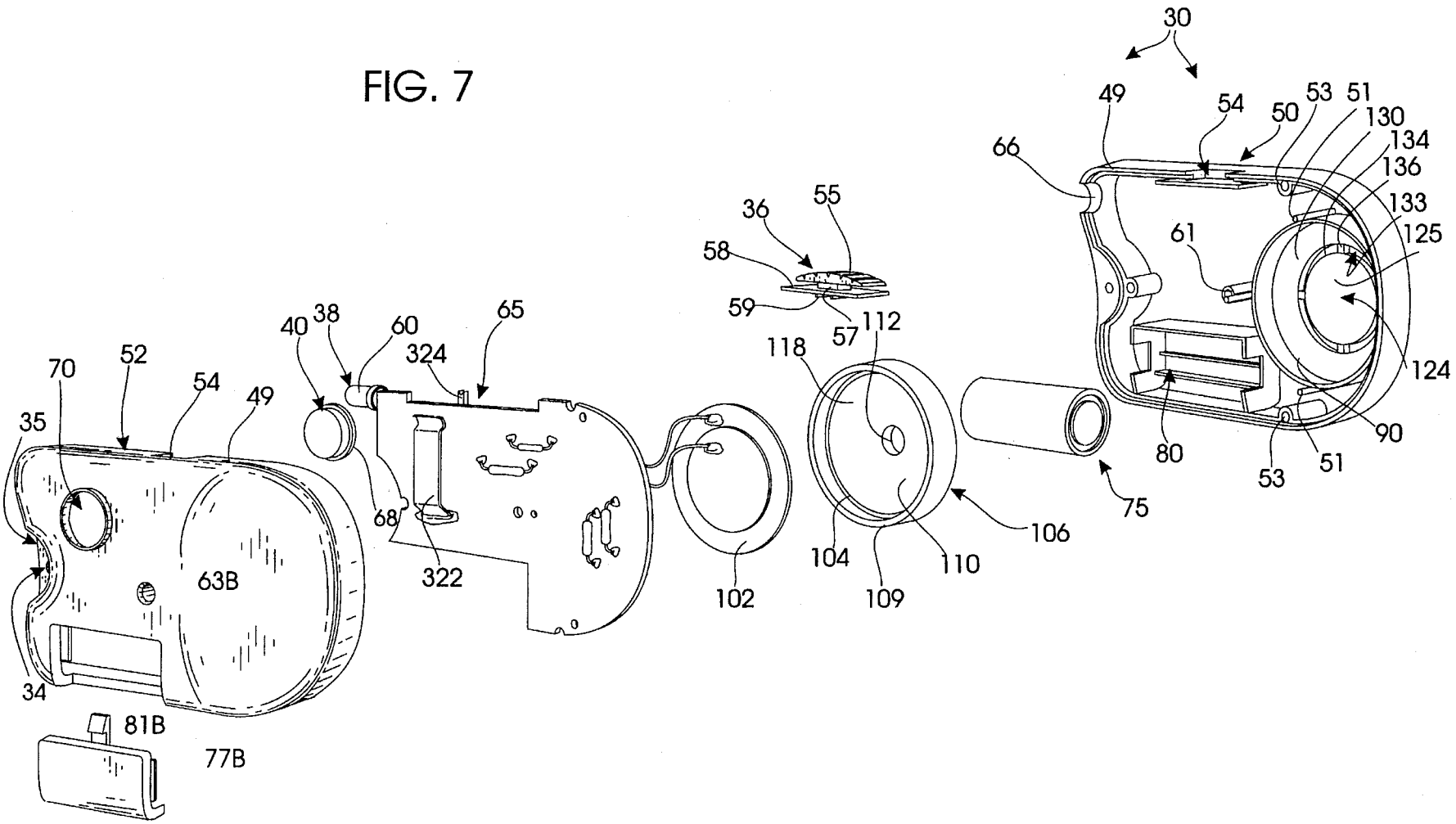
FIG. 7 is an exploded, rear perspective view of the invention illustrating the interrelationship of the principle components, with pieces omitted for clarity.

The preferred casing 32 (FIGS. 7–8) comprises two halves 50, 52 substantially equally split by the circuit board 65. The halves 50, 52 are joined by a screw 45 (FIG. 6) that enters boss 63B (FIG. 8), penetrates and secures the circuit board, and firmly seats within boss 61 (FIG. 7). The perimeters 49 of halves 50, 52 are substantially mirror images. The halves 50, 52 align and mate to form the casing 32. Several bosses 51 and corresponding sleeves 53 insure the proper alignment of the halves 50, 52 when they are assembled to form the casing 32.

The eyelet 34 is formed in reduced portion 35 of the front, exterior periphery of each of the halves 50, 52. The eyelet 34 captivates a key ring or similar device. The main switch 36 is slidably captivated by a slot 54 formed between the two halves 50, 52. The switch 36 comprises a convex serrated exterior 55 that permits a user to easily move the switch in a horizontal plane. A hollow, vertical column 57 supports the exterior 55 in a spaced relationship with sliding plate 58. A pair of tabs 59 depend downwardly from the plate 58. The switch 36 moves among an off, light on or alarm on positions.

Figure 8:
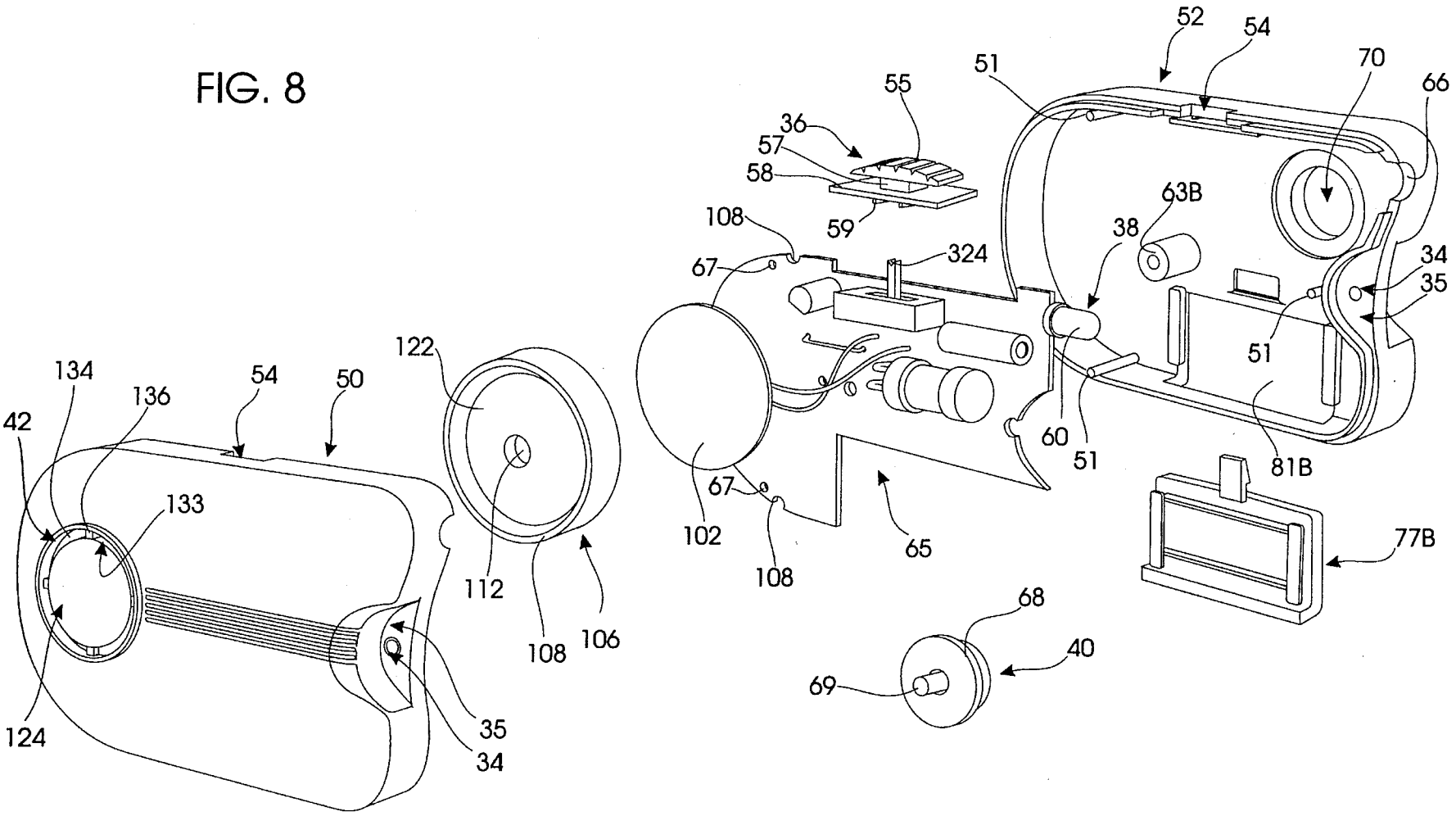
FIG. 8 is an exploded, front perspective view of the invention illustrating the interrelationship of the principle components, with pieces omitted for clarity.

The light 38 preferably comprises a light emitting diode 60, commonly referred to as a LED, physically mounted on a circuit board 65 that may be screwed to an internal boss 63 (FIG. 8). The LED 60 extends at least partially through orifice 66 in the casing 32. Moving the switch 36 to the light on position and depressing the complementary push button 40 activates the LED 60.

The complementary, plastic button 40 is wedged between the circuit board 65 and the half 52. A raised annular flange 68 circumscribes the base of push button 40. A downwardly projecting, circular activating pin 69 depends from the flange 68. The flange 68 has a wider diameter than button orifice 70. Therefore, the button 40 remains captivated between half 52 and the circuit board 65.

A plurality of orifices 67 penetrate the circuit board 65. The orifices 67 receive several alignment bosses 68 formed in half 50 to seat the circuit board within the casing 32. Several peripheral indentations 108 also serve to align the circuit board between halves 50, 52.

Figure 9:
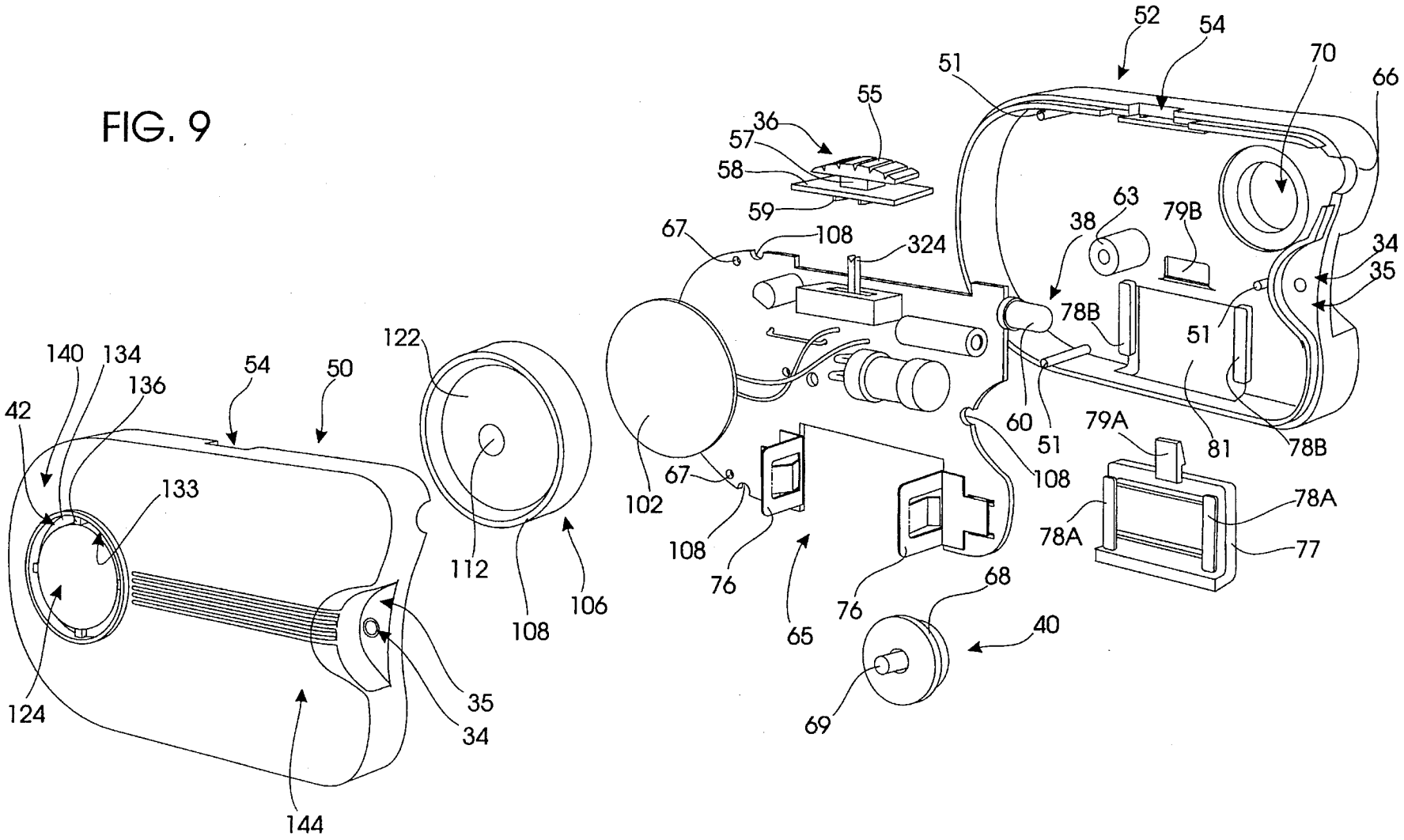
FIG. 9 is an exploded, front perspective view of an alternative embodiment of the invention illustrating the interrelationship of the principle components, with pieces omitted for clarity.

The preferably twelve-volt battery 75 is contained in casing 32 that is integral with the casing 32. In the best mode a battery housing 80 formed on half 50 (FIG. 7) captivates battery 75, that is electrically connected to the circuit board 65. In an alternative embodiment (FIG. 9), the four separate batteries are electrically connected in series and captivated within and between the circuit board connector ends 76 (FIG. 9). The batteries of this latter embodiment are accessible by manipulating battery access door 77 to permit access through orifice 81. Door 77 is aligned by integral, spaced apart guides 78A that are matingly received within follower slots 78B. Deflectable latch 79A is snugly received within indention 79B to yieldably lock the door to the casing. Door 77B (FIG. 8) is slightly wider than door 77, and it similarly snap fits into place over orifice 81B to provide access to the battery.

Figure 10:
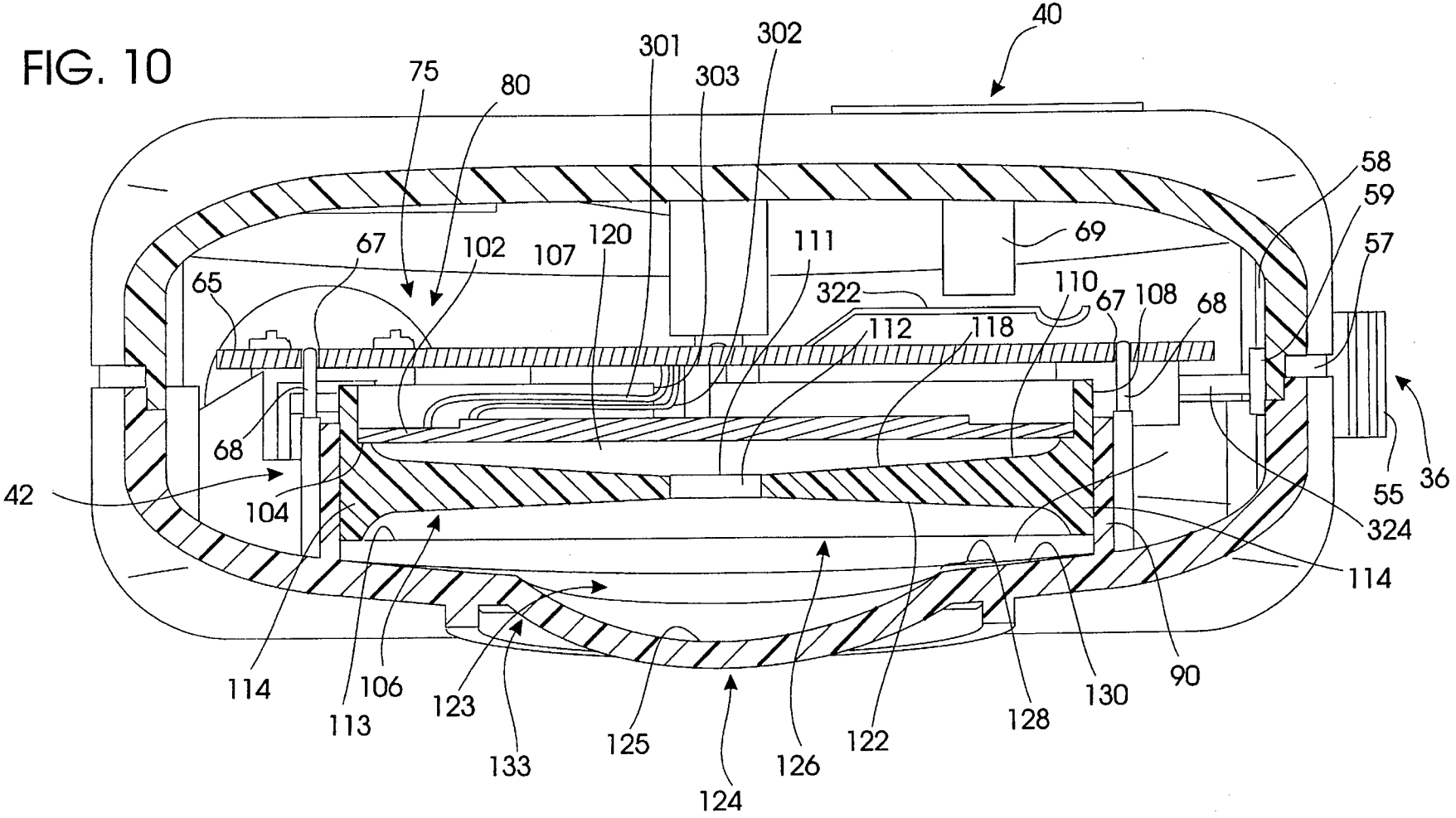
FIG. 10 is an enlarged cross-sectional view taken generally along line 10—10 of FIG. 3, illustrating the internal arrangement of the components of the alarm, with portions thereof broken away or shown in section for clarity.
Figure 11:
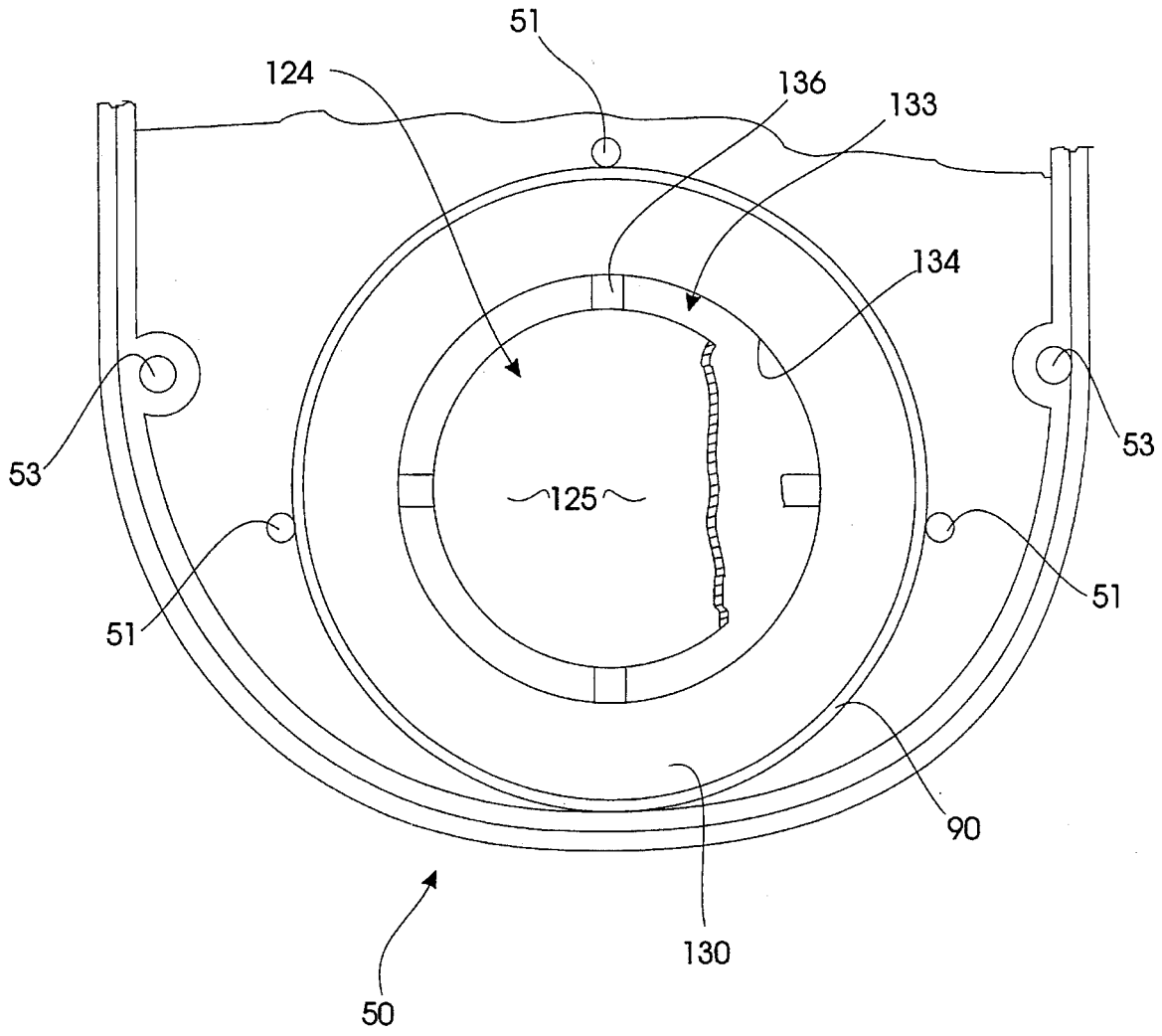
FIG. 11 is a fragmentary sectional view taken generally along line 11—11 in FIG. 10; and, FIG. 12 is an electrical schematic of the circuitry of the invention.

An integrally formed raised annular collar 90 occupies the rear portion of half 50. The raised annular collar 90 houses several components of the acoustically focusing speaker assembly 42 (as best seen in FIGS. 7,8 and 9). The speaker assembly 42 produces and emits an audible alarm signal.

speaker assembly 42 comprises a piezoelectric transducer 102 that vibrates when driven by an alternating current applied across it by the circuit 300, to be explained hereinafter. The circular transducer 102 is integrally glued to a annular ridge 104 within a resilient, circular resonator 106 (FIG. 10).

The rear surface of the transducer 102 faces the circuit board 65 and the interior surface 107 of the half 52. Together, the circuit board 65 and the interior surface 107 muffle most of the vibrations emanating from the rear surface of the transducer 102.

The resonator 106 is mounted within the raised annular collar 90 of the casing 32. Resonator 106 comprises a annular, peripheral ring 108 surrounding an integral, biconcave plate 110. The ring 108 is seated on a ledge 113 inside the annular collar 90. Plate 110 is thinnest at its interior center 111 and thickest at its outer circumference 114 adjacent the ring 108. A transmission orifice 112 penetrates the plate 110 at its center 111. The transducer 102 is mounted adjacent to the concave interior face 118 of plate 110 (as seen in FIG. 10).

An acoustic chamber 120 is formed between the interior plate face 118 and the transducer 102. The concave exterior plate face 122 reflects sound waves toward an outlet orifice 123. The outlet orifice 123 is substantially filled by reflector 124. The concave interior reflector surface 125 facing toward the concave exterior plate face 122. A reverberation chamber 126 is formed between the exterior plate face 122 and the interior reflector face 125.

The reverberation chamber 126 comprises three primary sections, the interior reflector surface 125, a radiant annulus section 128 and a peripheral, annular reflection surface 130. The interior reflector surface 125 reflects the transmitted sound waves from the transmission orifice 112 inwardly toward the exterior plate face 122.

The annular reflection surface 130 resonates and amplifies the sound waves produced by the vibrations of the exterior plate face 122. The annular reflection surface 130 also transforms the frequencies of these sound waves to mesh with the reflected sound waves. The radiant annulus section 128 cooperates with an output annulus 133 to emit an audible alarm signal.

The output annulus 133 surrounds the reflector 124. The annulus 133 comprises several radially spaced apart arcuate slots 134. The slots 134 surround the reflector 124. The annulus 133 is broken by a series of radially spaced apart spokes 136. The spokes 136 integrally extend from the casing 30 to the reflector 124. These spokes 136 integrally attach the reflector 124 to half 50 of casing 30. The slots 134 between the spokes 136 permit sound waves to radiate outwardly from the radiant section 128 of the reverberation chamber 126.

In the preferred embodiment, the diameter 138 of the transducer is approximately 1.25 inches. The diameter 139 of the plate orifice 112 is approximately 0.25 inches. The diameter 140 of the outlet orifice is approximately 0.75 inches. Thus, the ratio of the transducer 106 to the transmission orifice 112 to the outlet orifice 123 is 5:1:3.

A convex, exterior face 132 of reflector 124 forms the exterior surface of the speaker assembly 42. The convex face 132 reflects outwardly any sound waves striking it. The face 132 protrudes from rear surface 142 of the half 50. The face 132 cooperates with the reduced portion 35 located at the front section 144 of both halves 50, 52 and the switch 36 to provide an ergonomically efficient casing 32.

The transducer 102 is driven by the batteries 75 through the operation of circuit 300 on circuit board 65. Two wires 301, 302 are threaded through channel 303 formed in resonator 106. The wires 301, 302 provide the electrical current that induces the piezoelectric effect on transducer 102.

Figure 12:
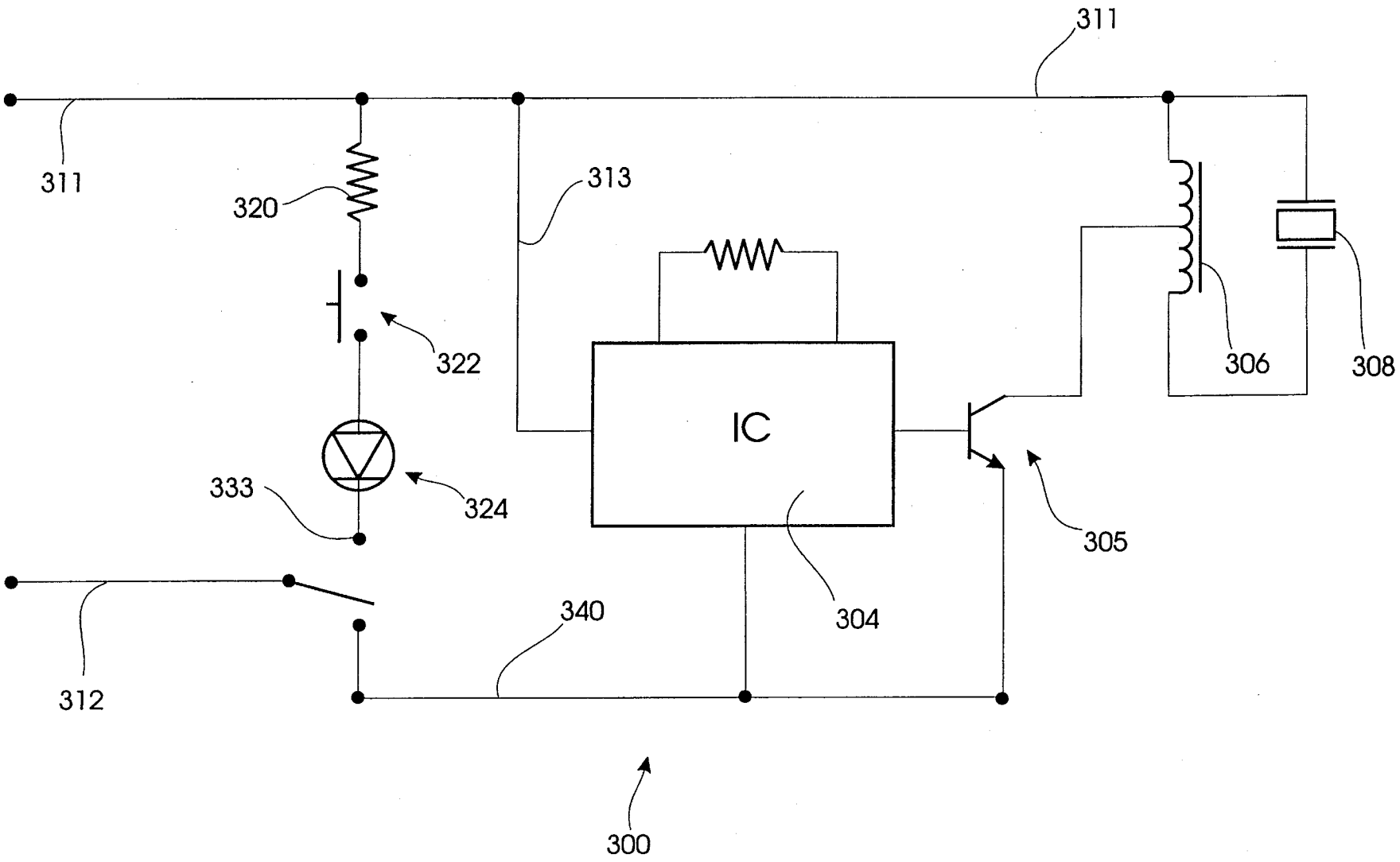

Circuit 300 that activates the electrical components of key chain alarm and light 30 (FIG. 12). A chip 304 drives output transducer 305 energizing inductor 306 and piezoelectric transducer 102. Batteries 75 provide electric power to circuit 300. The batteries 75 connect through input lead 311 and output lead 312 to circuit 300.

Input 311 connects to resistor 320 and spring switch 322. Spring switch 322 is closed when pin 69 on button 40 is depressed. Switch 324 is a single pole double throw microswitch that is deployed between positions by the main switch 36. The main switch captivates the switch 324 between the tabs 59 and inside column 57.

Operation

The operation of my key chain alarm and light is relatively simplistic. The switch 36 is moved among three position dependent upon the user's desires. The key chain alarm and light 30 may function as a flashlight to illuminate objects. When the switch 36 has been moved to the lights on position, the push button 40 must be depressed to activate the light 38.

Moving the switch 36 to the alarm position activates the speaker assembly 42. The speaker assembly 42 produces an extremely loud alarm signal to draw attention to the user. The speaker assembly 42 may be deactivated by simply moving the switch 36 to the off position.

While operating, the transducer 102 vibrates vigorously because of the current flowing through it. The resonator 106 also vibrates vigorously because transducer 102 is integrally attached to the resonator 106 at the annular ridge 104. These vibrations produce sound waves in the acoustic chamber 120 and in the reverberation chamber 126. The air inside the acoustic chamber 120 begins resonating as a result of the vibrations. The air then escapes through the transmission orifice 112 into the distribution chamber 126.

As the sound waves escape from the acoustic chamber 120 through the transmission orifice 112, they are reflected by the concave face of reflector 124. This reflection causes the reflected waves to mesh with other sound waves in the reverberation chamber 126. These other waves include additional sound waves are produced as a result of the vibration of the exterior face 122 of the resonator 106. This meshing of sound waves produces the audible alarm signal.

The reverberation chamber 126 also forces the sound waves to harmoniously resonate to increase the amplitude of the alarm signal. The sound waves within the reverberation chamber are continuously reflected until they reach a predetermined amplitude and frequency. These desired sound waves then radiate exteriorly outwardly from the radiant section 128 of the reverberation chamber 126.

The outward movement of these sound waves produces an audible, piercing alarm signal that draws immediate attention to the user.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A key chain alarm and light assembly comprising:

a portable ergonomic casing adapted to be transported by a user, said casing comprising a first half and a second half adapted to be coupled together, said halves having perimeters that are substantial mirror images of one another, said coupled halves defining an interior, an exterior, and a portion adapted to be coupled to a key chain or an eyelet;

a piezoelectric transducer disposed within said casing for acoustically vibrating air and producing loud sounds calling attention to the user;

a resonator for mounting said transducer, said resonator comprising a biconcave plate spaced apart from said transducer and surrounded by a peripheral ring;

an acoustic chamber formed within said resonator between said transducer, said plate, and said ring;

an annular housing within said casing for receiving said resonator, said ring coaxially fitting within said housing;

a reverberation chamber defined within said housing beneath said plate, said reverberation chamber bounded by an annular reflective surface formed in said casing and spaced apart from said plate;

a transmission orifice defined in said plate for connecting said acoustic and reverberation chambers in fluid flow communication;

an outlet orifice defined in said casing adjacent said housing for connecting said reverberation chamber in fluid flow communication with the exterior of said casing, said outlet orifice generally concentric with said transmission orifice and said annular reflective surface, said outlet orifice having a circular periphery;

a reflector disposed within said outlet orifice for reflecting sound within said reverberation chamber;

circuit means for activating said alarm means, said circuit means comprising a circuit board captivated between said casing halves;

light means projecting from said casing for selectively illuminating said key chain or an eyelet; and, switch means for selectively activating said circuit means or said light means, said switch means comprising a primary switch slidably captivated between said casing halves within a slot formed on the perimeter of both halves.

2. The key chain alarm and light assembly as described in claim 1 wherein said switch means further comprises a push button switch controlled by said primary switch and operable to activate said light means.

3. The key chain alarm and light assembly as described in claim 2 wherein the ratio of the transducer diameter to the transmission orifice diameter to the outlet orifice diameter is 5 to 1 to 3.

4. The key chain alarm and light assembly as described in claim 3 wherein said transducer diameter is between one quarter of an inch and three inches.

5. A key chain alarm and light assembly comprising:

a portable ergonomic casing adapted to be transported by a user, said casing comprising an interior, an exterior, and a portion adapted to be coupled to a key chain;

a piezoelectric transducer disposed within said casing for acoustically vibrating air and producing audible sounds calling attention to the user;

a resonator for mounting said transducer, said resonator comprising a biconcave plate spaced apart from said transducer and surrounded by a peripheral ring;

an acoustic chamber formed within said resonator between said transducer, said plate, and said ring;

an annular housing within said casing for receiving said resonator, said ring coaxially fitting within said housing;

a reverberation chamber defined within said housing beneath said plate, said reverberation chamber bounded by an annular reflective surface formed in said casing and spaced apart from said plate;

a transmission orifice defined in said biconcave plate for connecting said acoustic and reverberation chambers in fluid flow communication;

an outlet annulus defined in said casing adjacent said housing for connecting said reverberation chamber in fluid flow communication with the exterior of said casing, said outlet annulus generally concentric with said transmission orifice and said annular reflective surface, said outlet annulus having a circular periphery;

a reflector surrounded by said outlet annulus for reflecting sound within said reverberation chamber, said reflector having a concave inner surface facing said transmission orifice and a convex outer surface projecting outwardly from said casing for distributing sound emanating from said outlet annulus;

circuit means for activating said alarm means;

light means projecting from said casing for selectively illuminating said key chain; and, switch means for selectively activating said circuit means or said light means.

6. The key chain alarm and light assembly of claim 5 wherein said outlet annulus is subdivided into a plurality of radially spaced apart, arcuate radiation slots.

7. A battery powered personal key chain alarm and light adapted to selectively function as a light or an alarm, said alarm and light comprising:

an ergonomic casing that facilitates handling of the alarm, said casing comprising a first and a second halves, the perimeters of said halves being substantially mirror images with a slot formed between said halves;

a switch partially slidably captivate within said slot and a complementary push button partially housed between said first half and a circuit board, said push button penetrating an orifice formed in said first half, said switch and said push button adapted to cooperatively activate a light to illuminate objects, said light physically mounted on said circuit board housed inside said casing;

an annular collar formed between said circuit board and said second half;

a speaker assembly partially housed within said collar and captivated by said collar, said speaker assembly adapted to produce an audible alarm signal and comprising:

a transducer for acoustically vibrating to produce sound waves;

a spaced apart biconcave, circular plate adjacent said transducer and forming an acoustic chamber therebetween, said acoustic chamber resonating said sound waves;

a circular transmission orifice penetrating said plate at the center thereof and permitting the transmission of said sound waves from said acoustic chamber;

a concave reflector integrally attached to one of said halves and concentrically spaced apart from said transmission orifice, said reflector preventing the immediate escape of at least some of said sound waves; and, a reverberation chamber between said plate and said reflector, said reverberation chamber harmoniously amplifying said sound waves;

said circuit board adapted to selectively activate said speaker assembly or said light; and, at least one battery housed within said casing and adapted to provide electrical power to activate said circuit board.

* * * * *